United States Patent [19]

Poyer

[11] Patent Number: 4,763,233

[45] Date of Patent: Aug. 9, 1988

[54] OUTDOOR MARINE LIGHTING FIXTURE

[76] Inventor: David D. Poyer, 858 Roseway St., Naples, Fla. 33942

[21] Appl. No.: 943,745

[22] Filed: Dec. 19, 1986

[51] Int. Cl.[4] ..... F21V 29/00

[52] U.S. Cl. ..... 362/267; 362/216; 362/260; 362/375; 362/431; 362/363; 362/311

[58] Field of Search ..... 362/267, 216, 260, 296, 362/299, 328, 362, 375, 431, 363

[56] References Cited

U.S. PATENT DOCUMENTS

| | | | |
|---|---|---|---|
| 2,748,255 | 5/1956 | Decker | 362/299 X |
| 3,109,960 | 5/1963 | Bell et al. | 362/260 |
| 3,902,057 | 8/1975 | LaViolette | 362/267 |
| 4,210,841 | 7/1980 | Vodicka et al. | 362/267 |
| 4,238,709 | 12/1980 | Wallace | 362/296 X |
| 4,360,862 | 11/1982 | Strasser et al. | 362/240 |
| 4,379,321 | 4/1983 | Plemmons et al. | 362/267 |
| 4,380,793 | 4/1983 | Potts | 362/267 |
| 4,414,613 | 11/1983 | Mayer | 362/267 |
| 4,450,511 | 5/1984 | Micha | 362/267 |
| 4,489,367 | 12/1984 | Herron et al. | 362/375 X |
| 4,523,263 | 6/1985 | Poyer | 362/267 |
| 4,564,890 | 1/1986 | Poyer | 362/431 X |
| 4,617,615 | 10/1986 | Eychaner | 362/216 |
| 4,646,214 | 2/1987 | Mendleski | 362/362 X |

FOREIGN PATENT DOCUMENTS

| | | | |
|---|---|---|---|
| 1139560 | 1/1969 | United Kingdom | 362/267 |
| 1201141 | 8/1970 | United Kingdom | 362/267 |

*Primary Examiner*—Larry Jones

*Attorney, Agent, or Firm*—Merrill N. Johnson

[57] ABSTRACT

An economical and rugged lighting fixture designed particularly for dock-side use. The fixture's major components include a funnel-shaped main housing of polyvinyl chloride having a cylindrical upper end and a cylindrical lower end of reduced diameter; a main housing extension of polyvinyl chloride having the same diameter as the lower end of said main housing and having an annular ring projecting frm its inner wall; a hollow cylindrical housing sized to fit into the upper cylindrical end of said main housing; a U-shaped fluorescent lamp; a socket for said lamp; a 120 volt transformer; a circular socket mounting bracket sized to fit snugly onto the annular ring of the main housing extension and carrying the fluorescent lamp socket and the transformer; a dished reflector surrounding the lower end of the lamp and whose outer edge is secured between the lower end of the cylindrical housing and the flared wall of the main housing; and a flat circular transparent lens bonded to the upper end of said main housing.

3 Claims, 1 Drawing Sheet

OUTDOOR MARINE LIGHTING FIXTURE

BACKGROUND AND SUMMARY OF THE INVENTION

My invention relates to an economical and rugged electric lighting fixture using a standard voltage U-shaped fluorescent lamp designed particularly for dock-side use and constructed mainly of polyvinyl chloride (PVC) resin.

Until recently, most electric lighting fixture housings have been made of metal. However, for lighting fixtures designed for dock-side use, most metal housings are subject to rapid corrosion due to constant exposure to rain and sun and, in coastal areas, to salt spray, even when the metal parts are temporarily protected by paint.

My prior U.S. Pat. No. 4,564,890 discloses an outdoor lighting fixture constructed largely of PVC and using a U-shaped fluorescent lamp. I have now invented an improved lighting fixture especially adapted for marine and dock-side use.

As mentioned in my aforesaid prior patent, there are a number of prior suggestions in the art to use various plastic and elastomeric resins in the fabrication of lighting fixture components. These suggestions include U.S. Pat. Nos. 3,902,057; 4,210,841; 4,360,862; 4,379,321; 4,380,793; 4,414,613; 4,523,263 and 4,564,890.

However, my improved outdoor lighting fixture using a standard voltage U-shaped fluorescent lamp possesses a number of advantages over previous outdoor fixtures.

1. Because it comprises only components which are already manufactured in quantity, the cost of its components is lower than the cost of conventional outdoor lighting components.

2. Because of the simplicity of the fixture and its components which can be quickly assembled by unskilled labor, my lighting fixture costs less to manufacture than conventional fixtures.

3. Because its housing is made of PVC, my lighting fixture is more rugged and less subject to corrosion than conventional fixtures.

My improved outdoor lighting fixture includes the following components: a funnel-shaped main housing of polyvinyl chloride having a cylindrical upper end and a cylindrical lower end of reduced diameter; a main housing extension of polyvinyl chloride having the same diameter as the lower end of said main housing and having an annular ring projecting from its inner wall; a hollow cylindrical housing sized to fit into the upper cylindrical end of said main housing; a U-shaped fluorescent lamp; a socket for said lamp; a 120 volt transformer; a circular socket mounting bracket sized to fit snugly onto the annular ring of the main housing extension and carrying the fluorescent lamp socket and the transformer; a dished reflector surrounding the lower end of the lamp and whose outer edge is secured between the lower end of the cylindrical housing and the flared wall of the main housing and a flat circular transparent lens bonded to the upper end of said main housing.

DETAILED DESCRIPTION OF THE PREFERRED EMBODIMENT

Figure 1:
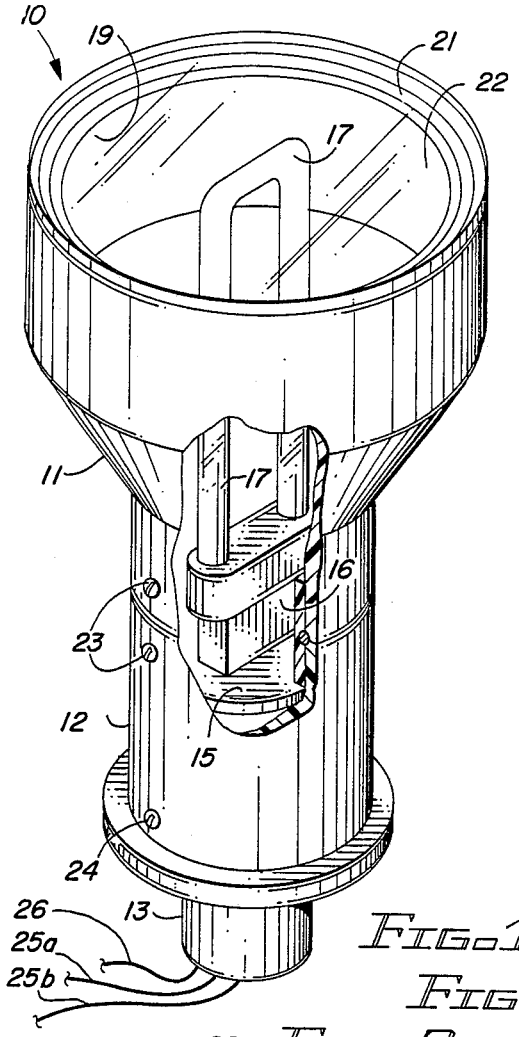
FIG. 1 is a perspective view partially broken away of a preferred embodiment of my assembled outdoor lighting fixture.

The drawings illustrate a preferred embodiment of my marine lighting fixture. FIG. 1 is a perspective view of assembled lighting fixture 10 with its funnel-shaped main housing 11 in an upright position above housing extension 12 and base plate 13. Main housing 11, housing extension 12 and base plate 13 are all preferably made of white high density polyvinyl chloride (PVC) manufactured to meet National Electrical Manufacturers Association standards designation EPC-40-PVC or EPC-80-PVC.

Main housing 11 is a standard PVC pipe increaser coupling used conventionally for joining electrical plastic conduit (EPC). Housing extension 12 is a standard PVC cylindrical coupling used conventionally for joining EPC and has an annular ring **12*a* molded into the interior surface of housing. Ring 12*a* is preferably square in cross-section. Base plate 13** is a standard PVC pipe reducer coupling used in joining two different sizes of plastic conduit.

Figure 2:
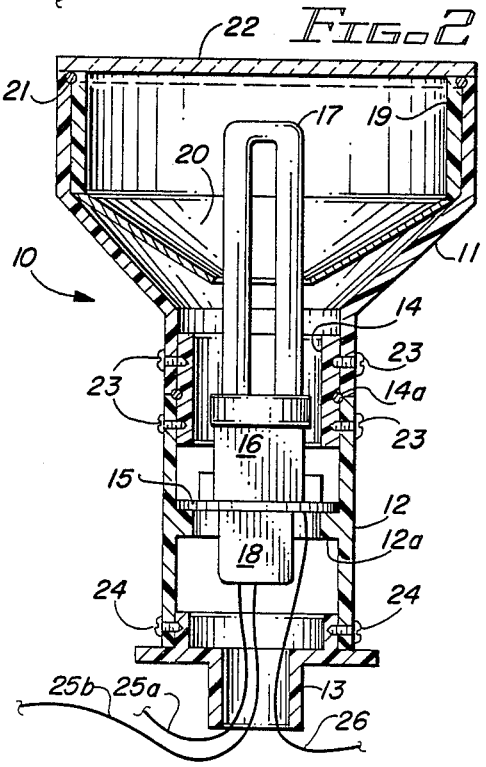
FIG. 2 is a cross-sectional side view of my lighting fixture shown in FIG. 1 specifying the details of the various components of the fixture and the manner of their assembly.
Figure 3:
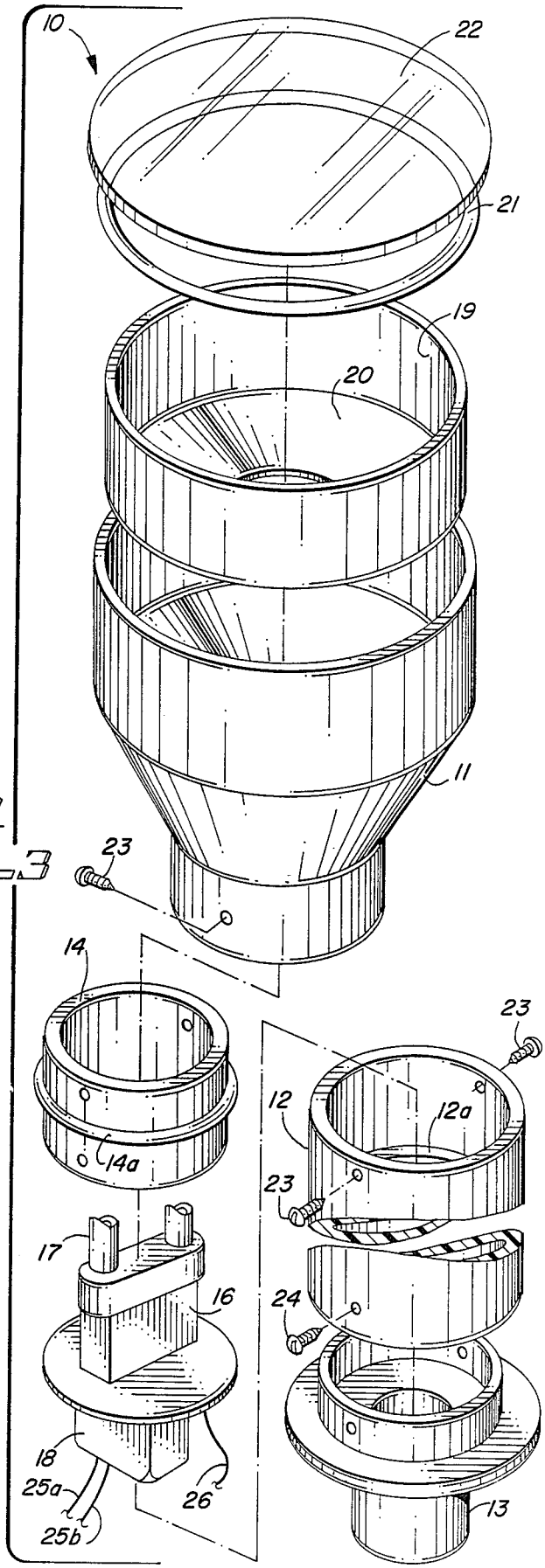
FIG. 3 is an exploded perspective view partially broken away of the lighting fixture which is shown in FIGS. 1 and 2.

FIGS. 2 and 3 show in detail the construction and components of my fixture 10. Main housing 11 and housing extension 12 are joined together by cylindrical spacer 14, annular resilient O-ring **14*a* and screws 23 as best shown in FIG. 2. The presence of O-ring 14*a* at the line of joinder of housing 11 and extension 12** insures a water-tight seal.

A U-shaped fluorescent lamp assembly rests on the upper edge of housing extension ring **12*a*. The assembly consists of a U-shaped fluorescent lamp 17, a preferably ceramic lamp socket 16, and a 120 volt transformer 18 all mounted on a flat circular metal mounting bracket 15**.

Lamp 17 may be a five watt input, 40 watt output Osram lamp, part F5TT-41 or other U-shaped fluorescent lamp with a bayonet-type base which plugs into socket 16 mounted on the upper face of bracket 15. Transformer 18 is mounted on the lower face of bracket 15 as best shown in FIG. 3.

The lamp assembly is preferably wired for 5 to 9 watt delivery to socket 16 and includes wires **25*a* and 25*b* for connection to a 110 volt power line. The outer edge of bracket 15 is sized slightly less than the inner diameter of extension 12 so that the entire lamp assembly can be easily inserted into extension 12 and mounted on the upper edge of ring 12*a* as shown in FIG. 2**.

The lower end of housing extension 11 is closed by base plate 13 which is secured to extension 12 by a plurality of stainless steel screws 24. 110 volt lines **25*a* and 25*b* and grounding wire 26 exit from the lamp assembly through the axial hole in base plate 13. The lower cylindrical end of base plate 13 may be inserted into or otherwise mounted on a post to provide illumination to a dock or other marine installation. Alternatively, electrical lines 25*a*, 25*b* and 26 can be passed through a resilient doughnut-shaped gromet (not shown) plugged into the lower end of base plate 13** to seal the lighting fixture.

Before main housing 11 is connected to housing extension 12, a dish-shaped mirror-coated reflector 20 whose outer diameter is slightly less than the inside diameter of the upper end of housing 11 is inserted into the open upper end of housing 11. The reflector 20 is held in place between the conical inner surface of housing 11 and the lower end of cylindrical spacer 19 preferably made of PVC.

A semi-circular groove in the upper ends of housing 11 and spacer 19 provides a seat for a resilient O-ring 21. Ring 21 insures a waterproof seal between lens 22 and housing 11 and spacer 19. While lens 22 is shown as a flat circular disk of clear transparent plastic material, lenses having other shapes and colors may be used. Preferably lens 22 is permanently sealed to housing 11, O-ring 21 and spacer 19 by an epoxy glue or similar bonding agent.

In the manufacture of my marine lighting fixture, preferably the lamp assembly (fluorescent lamp 17, socket 16, bracket 15, transformer 18 and wires **25*a*, 25*b* and 26) are first assembled. Base plate 13 is then connected to housing extension 12 by screws 24. Next the lamp assembly is mounted on the upper edge of the ring 12*a* as best shown in FIG. 2. Then, using cylindrical spacer 14, O-ring 14*a* and screws 23, housing 11 with its reflector 20 and lens 22 already in place is joined to housing extension 12** and the lamp assembly.

While lamp 17 is now securely sealed within the fixture, the lens and the PVC housings and base plate will not deform or deteriorate due to either the internal heat generated by operation of the lamp or by constant exposure to the sun, rain and salt spray associated with boat docks and other marine installations, especially in the coastal sunbelt areas of the United States.

While I have shown and described a preferred embodiment of my marine lighting fixture, it will be apparent to those skilled in the art that various modifications may be made without departing from the scope and spirit of my invention. No limitations as to my invention should be inferred from the foregoing description as the scope of my invention is defined only by the following claims.

I claim:

1. A fluorescent lighting fixture designed for outdoor use comprising:

a funnel-shaped main housing of polyvinyl chloride having a cylindrical upper end, a conically flaring center portion, and a cylindrical lower end of reduced diameter, a main housing extension of polyvinyl chloride having the same diameter as the lower end of the main housing and having an annular ring projecting from its inner wall, a circular bracket having upper and lower flat faces and sized to fit onto the annular ring projecting from the inner wall of the housing extension, a lamp socket mounted on the upper flat face of the bracket, a U-shaped fluorescent lamp mounted in the socket, a 120 volt transformer mounted on the lower flat face of the bracket and electrically connected to the socket, a cylindrical spacer whose outer diameter is slightly less than the inner diameter of the upper end of the main housing and whose length equals the length of the upper end of the main housing, a dish-shaped reflector sized to fit within the main housing and whose outer circular edge is secured between the flared inner wall of the main housing and the lower end of the cylindrical spacer, and a circular-edged transparent lens bonded to the upper end of the main housing.

2. A fluorescent lighting fixture as set forth in claim 1 which includes a second cylindrical spacer whose outer diameter is slightly less than the inner diameter of the housing extension and lying partially within the lower end of the main housing and partially within the upper end of the housing extension and connected to both.

3. A fluorescent lighting fixture as set forth in claim 1 which includes a base plate for closing the lower end of the housing extension and having exit means for the wires which electrically energize the lamp.

* * * * *